US005894115A

United States Patent [19]

Weiner

[11] Patent Number: 5,894,115

[45] Date of Patent: Apr. 13, 1999

[54] EXHAUST SYSTEM APPARATUS AND NOISE SUPPRESSION METHOD

[75] Inventor: Phillip J. Weiner, St. Louis Park, Minn.

[73] Assignee: Harborville Corporation, Tortola, Virgin Islands (Br.)

[21] Appl. No.: 08/982,494

[22] Filed: Dec. 2, 1997

[51] Int. Cl.[6] ..... F01N 1/08

[52] U.S. Cl. ..... 181/272; 181/237; 181/273

[58] Field of Search ..... 181/237, 241, 181/253, 254, 258, 269, 270, 271, 272, 273, 276, 277, 282

[56] References Cited

U.S. PATENT DOCUMENTS

| | | | |
|---|---|---|---|
| 1,761,971 | 6/1930 | Cram . | |
| 2,071,351 | 2/1937 | McNamara . | |
| 2,076,827 | 4/1937 | Ross . | |
| 2,202,272 | 5/1940 | Smith . | |
| 3,092,206 | 6/1963 | Moreau . | |
| 3,181,648 | 5/1965 | Bottum . | |
| 3,346,071 | 10/1967 | Lader . | |
| 3,703,937 | 11/1972 | Tenney | 181/277 |
| 3,841,841 | 10/1974 | Torosian et al. | 181/272 |
| 4,000,786 | 1/1977 | Ford . | |
| 4,167,987 | 9/1979 | Turner . | |
| 4,610,326 | 9/1986 | Kirchweger et al. . | |
| 5,196,655 | 3/1993 | Woods | 181/235 |
| 5,614,699 | 3/1997 | Yashiro et al. | 181/254 |
| 5,661,973 | 9/1997 | Casey | 181/270 |

*Primary Examiner*—Khanh Dang
*Attorney, Agent, or Firm*—Schwegman, Lundberg, Woessner, and Kluth, P.A.

[57] ABSTRACT

An exhaust system includes an exhaust pipe attached to the engine. Attached to the exhaust pipe is a muffler which has an exhaust gas inlet, a plurality of expansion chambers through which exhaust gas flows, and at least one wall between adjacent expansion chambers. There is an opening or orifice in the wall between adjacent expansion chambers. A flap which covers the orifice or the opening in the wall between adjacent expansion chambers. The flap opens in response to a pressurized surge of exhaust gas entering into the expansion chamber. The muffler also has an exhaust gas outlet for allowing exhaust gas to pass from the second chamber of the muffler. The exhaust system typically has a plurality of chambers attached to one another such that the exhaust gas travels along a tortuous path between the exhaust gas inlet and the exhaust gas outlet. The flap is pivotally attached to the wall between adjacent expansion chambers. The flap is also positioned so that it closes due to gravitational forces. The wall between adjacent expansion chambers is positioned on a plane that cuts the plane in which the exhaust gas inlet is positioned.

18 Claims, 4 Drawing Sheets

EXHAUST SYSTEM APPARATUS AND NOISE SUPPRESSION METHOD

FIELD OF THE INVENTION

The present invention relates generally to exhaust systems for internal combustion engines. More particularly, the present invention relates to a muffler for use in an exhaust system.

BACKGROUND OF THE INVENTION

Automobile engines have been produced with various numbers of cylinders over the years (from 2 to 16), but the most common engines in modem cars are in-line four-cylinder designs for smaller cars, and V-6 and V-8 designs for larger cars. All V-8 engines have an angle of 90 degrees between the two banks of four cylinders, whereas the V-6 engines have an angle of either 60 degrees or 90 degrees between the two banks of three cylinders. Smaller engines, in terms of both cylinder number and displacement, provide improved fuel economy, which is particularly important because of rigid federal corporate average fuel economy (CAFE) standards. Neither four- nor six-cylinder engines operate as smoothly as a V-8 because of less effective dynamic balancing and greater torque fluctuations.

Nearly every internal combustion engine includes a muffler. A wide variety of muffler designs have been employed in the prior art. Internal combustion engines operating under full loads have quickly opening exhaust valves that release quick surges of exhaust gas under substantial residual pressure. For example, the pressure of an exhaust gas surge may be as high as 2.7 atmospheres. In an automobile engine, the engine releases large periodic amounts or surges of pressurized gas. It is common knowledge that, if not muffled, such sudden releases of pressurized gas produce considerable objectionable noises or compressional sound waves having various frequency components. In the case of a four cylinder, four-stroke cycle engine, the exhaust gas surges are produced once every revolution. Thus, in the example of a four cylinder, four-stroke cycle engine operating at 3000 R.P.M., or fifty revolutions per second, fifty exhaust gas surges are produced per second which has a high likelihood of causing objectional noises or compressional sound waves.

Exhaust systems have several purposes, one of which is to direct the output gases from the engine to a position near the periphery of the automobile. A muffler is used in the exhaust gas system to silence the objectional noises or compressional sound waves caused by the periodic gas surges output from the engine. In order to be efficient as sound silencers, exhaust mufflers must decrease the exhaust gas velocity and either absorb the sound waves or cancel them by interference with other waves form the same source. Mufflers should have volumes 6 to 8 times the piston displacement and may contain baffles with or without holes. Mufflers that cancel sound waves by interference usually break the waves into two parts which follow different paths and meet again, out of phase, before leaving the muffler.

Exhaust gas back pressure should be kept to a minimum since an increase of 1 $lb/in^2$ (6.9 Kpa) in back pressure decreases the maximum power output about 2 percent, about 1 percent being due to more exhaust work and the balance of the effect of increased clearance gas pressure on volumetric efficiency.

In addition to objectionable noise, exhaust gas from an internal combustion engine generally includes a variety of constituents that are considered to be pollutants. Such exhaust gas constituents include unburned hydrocarbons and carbon monoxide (CO). Engine exhaust systems typically include a catalytic converter for treating the exhaust gas by promoting more complete oxidation of the exhaust gas constituents, by changing unburned hydrocarbons to carbon dioxide ($CO_2$) and water, and changing carbon monoxide (CO) to carbon dioxide ($CO_2$).

Mufflers today have a variety of problems. Among the problems are that the construction of a muffler using baffles or multiple gas paths is generally fairly expensive. An alternative that could be built for less money would be attractive.

SUMMARY OF THE INVENTION

An exhaust system includes an exhaust pipe attached to the engine. Attached to the exhaust pipe is a muffler which has an exhaust gas inlet, a plurality of expansion chambers through which exhaust gas flows, and at least one wall between adjacent expansion chambers. There is an opening or orifice in the wall between adjacent expansion chambers. A flap which covers the orifice or the opening in the wall between adjacent expansion chambers. The flap opens in response to a pressurized surge of exhaust gas entering into the expansion chamber. The muffler also has an exhaust gas outlet for allowing exhaust gas to pass from the second chamber of the muffler. The exhaust system typically has a plurality of chambers attached to one another such that the exhaust gas travels along a tortuous path between the exhaust gas inlet and the exhaust gas outlet. The flap is pivotally attached to the wall between adjacent expansion chambers. The flap is also positioned so that it closes due to gravitational forces.

The wall between adjacent expansion chambers is positioned on a plane that cuts the plane in which the exhaust gas inlet is positioned. A catalytic converter is also attached to the exhaust pipe of the exhaust system. The muffler muffles the sound produced by compression waves of gas by routing exhaust gas into a first chamber, then routing exhaust gas past a flap and into a second chamber, and then passing the exhaust gas out of the second chamber. The flap interrupts the flow such that the compression waves are also disrupted. This serves to muffle the sound. Advantageously, the muffler can be manufactured more economically than other mufflers.

BRIEF DESCRIPTION OF THE DRAWINGS

While the novel features of the invention are set forth with particularity in the appended claims, the invention, both as to organization and content, will be better understood and appreciated from the following detailed description taken in conjunction with the drawings, in which:

DESCRIPTION OF THE EMBODIMENT

In the following detailed description of the embodiment, reference is made to the accompanying drawings which form a part hereof, and in which is shown by way of illustration specific preferred embodiments in which the invention may be practiced. These embodiments are described in sufficient detail to enable those skilled in the art to practice the invention, and it is to be understood that other embodiments may be utilized and that structural, logical and electrical changes may be made without departing from the spirit and scope of the present inventions. The following detailed description is, therefore, not to be taken in a limiting sense, and the scope of the present inventions is defined only by the appended claims.

Figure 1:
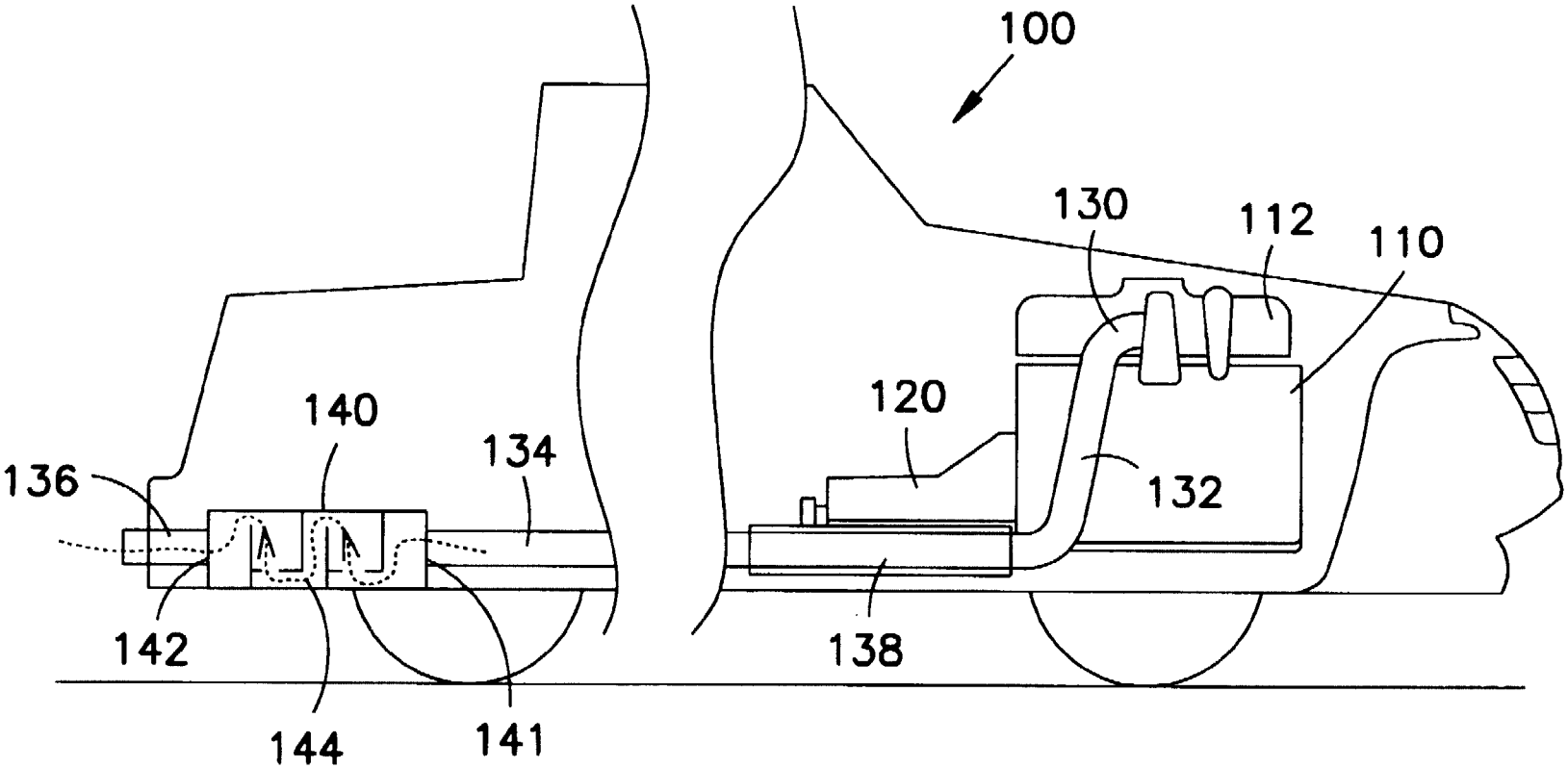
FIG. 1 is a side view of vehicle having an engine and a muffler.

FIG. 1 is a side view of a vehicle, such as an automobile 100, which includes an engine 110 mounted within an engine compartment of the automobile 100. The engine 110 drives a transmission 120 which in turn drives the wheels of the automobile 100. The engine 110 includes an exhaust manifold 112. The exhaust manifold takes the exhaust gases from the engine and routes them into an exhaust system 130. The exhaust system 130 includes pipes 132, 134 and tail pipe 136. Pipe 132 forms the connection between the exhaust manifold 112 and a catalytic converter 138. Pipe 134 is positioned between the catalytic converter 138 and a muffler 140. The tail pipe 136 is attached to the gas outlet of the muffler 140. Various elastomeric hangers hold the exhaust system 130 in place with respect to the frame of automobile 100. The hangers also prevent vibrations of the exhaust system 130 as exhaust gases from the engine 110 pass through the various portions of the exhaust system 130.

In FIG. 1, the muffler 140 is shown in a cutaway cross-sectional view. The muffler 140 includes a gas inlet 141 and a gas outlet 142. Within the muffler 140 are a series of chambers which are partitioned from one another by walls. The chambers and the walls as well as the openings in the walls will be discussed in more detail with respect to FIG. 2. Also shown in FIG. 1 is a dotted line which depicts the tortuous path through which the exhaust gases must take as they pass through the muffler 140. In order to show the tortuous path more clearly, a series of flaps, which are internal to the muffler 140, have been eliminated from FIG. 1 for the sake of illustration. Again, the flaps, walls and chambers will be discussed in further detail in FIGS. 2–4. The tortuous path of the gas is depicted by the reference numeral 144 in FIG. 1.

Figure 2:
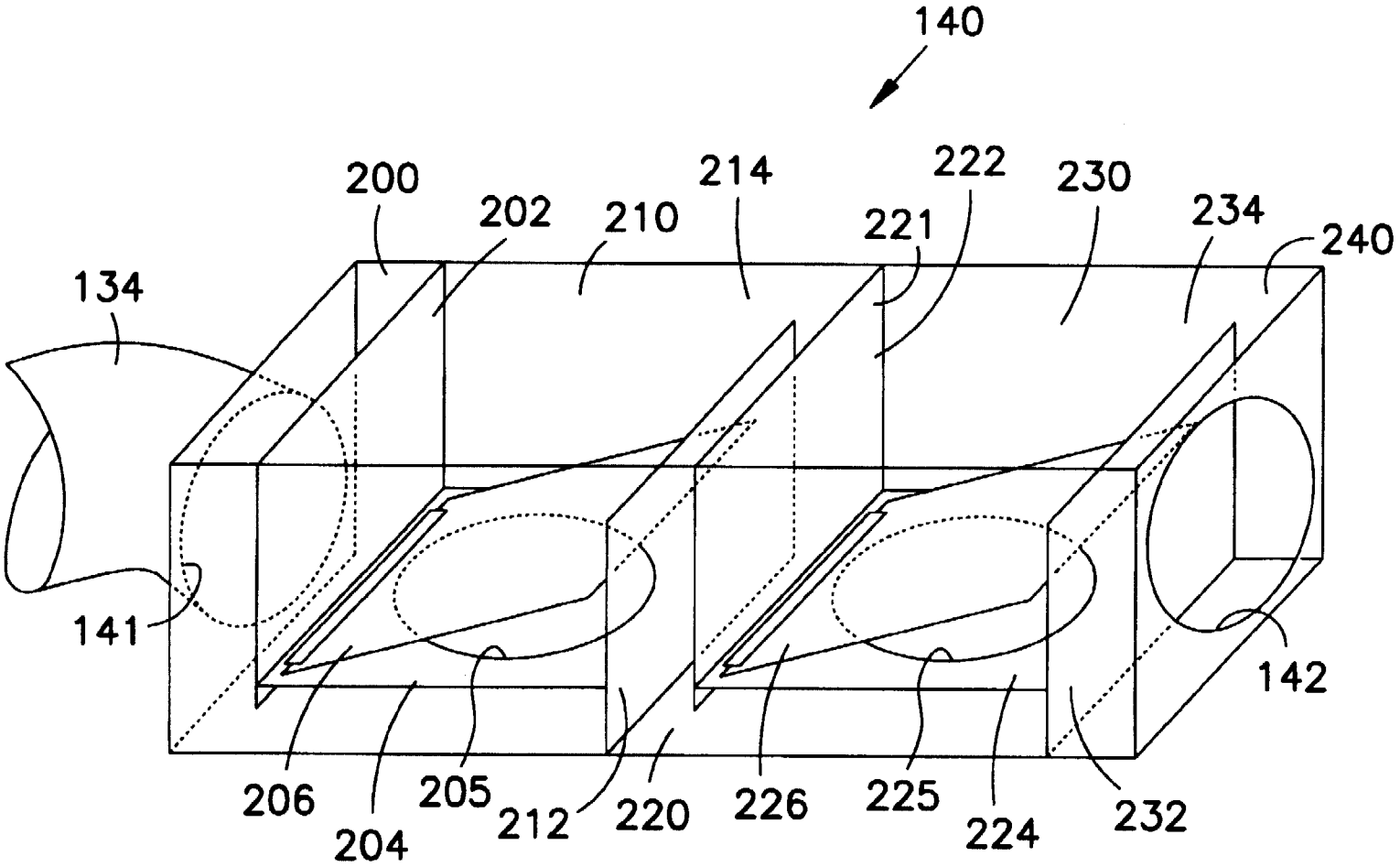
FIG. 2 is a perspective view of a first embodiment of the muffler.

FIG. 2 is a perspective view of a first embodiment of the muffler 140. Muffler 140 has an inlet 141 and an outlet 142. Muffler 140 has a series of chambers which are partitioned from adjacent chambers by a series of walls. As the exhaust gas from pipe 134 enters the inlet 141, the exhaust gas passes into a first chamber 200. The chamber 200 is bounded by the exterior walls of the muffler and a first L-shaped wall 202. The L-shaped wall has a first wall portion 202 and a second wall portion 204. The second portion of the wall 204 has an opening 205 therein. The opening 205 is in a plane which is transverse to the plane in which the inlet opening 141 is situated. A flap 206 is hingedly attached to the second portion 204 of the L-shaped wall. The flap 206 covers the opening 205 in the second portion 204 of the L-shaped wall. The flap 206 closes when exhaust gases are not passing through the muffler 140. The L-shaped wall acts as a partition between the first chamber 200 and a second chamber 210. When the gas passes through the opening 205 and past the flap 206, it is in the second chamber 210. A wall 212 partitions the second chamber from a third chamber 220. The wall 212 has an opening 214 near the edge of the wall 212 most distant from the opening 205 to the second chamber 210. The opening 214 is along the width of the wall 212. The third chamber 220 is bound by wall 212 and a second L-shaped wall 221. L-shaped wall 221 includes a first portion 222 and a second portion 224. The second portion 224 of the L-shaped wall 221 includes an opening 225. A flap 226 is hingedly attached to the second portion 224 of the L-shaped wall 221. The flap 226 covers the opening 225 when exhaust gases are not passing through the muffler 140. When the exhaust gases pass through the opening 225, the exhaust gas enters a fourth chamber 230. The fourth chamber 230 is bound by the L-shaped wall 221, the exterior walls of the muffler and a wall 232. Wall 232 has an opening 234 therein. The opening 234 is positioned along the width-wise dimension of the muffler 140 and is positioned at a point that is most distant from the opening 225 in the second portion 224 of the L-shaped wall 221. The wall 232 separates the fourth chamber 230 from a fifth chamber 240. The fifth chamber 240 is bound by wall 232 and the exterior surfaces of the muffler 140. The fifth chamber includes the exhaust gas outlet 142. The exhaust gas outlet 142 allows the exhaust gases to pass into the tail pipe 136.

Figure 3:
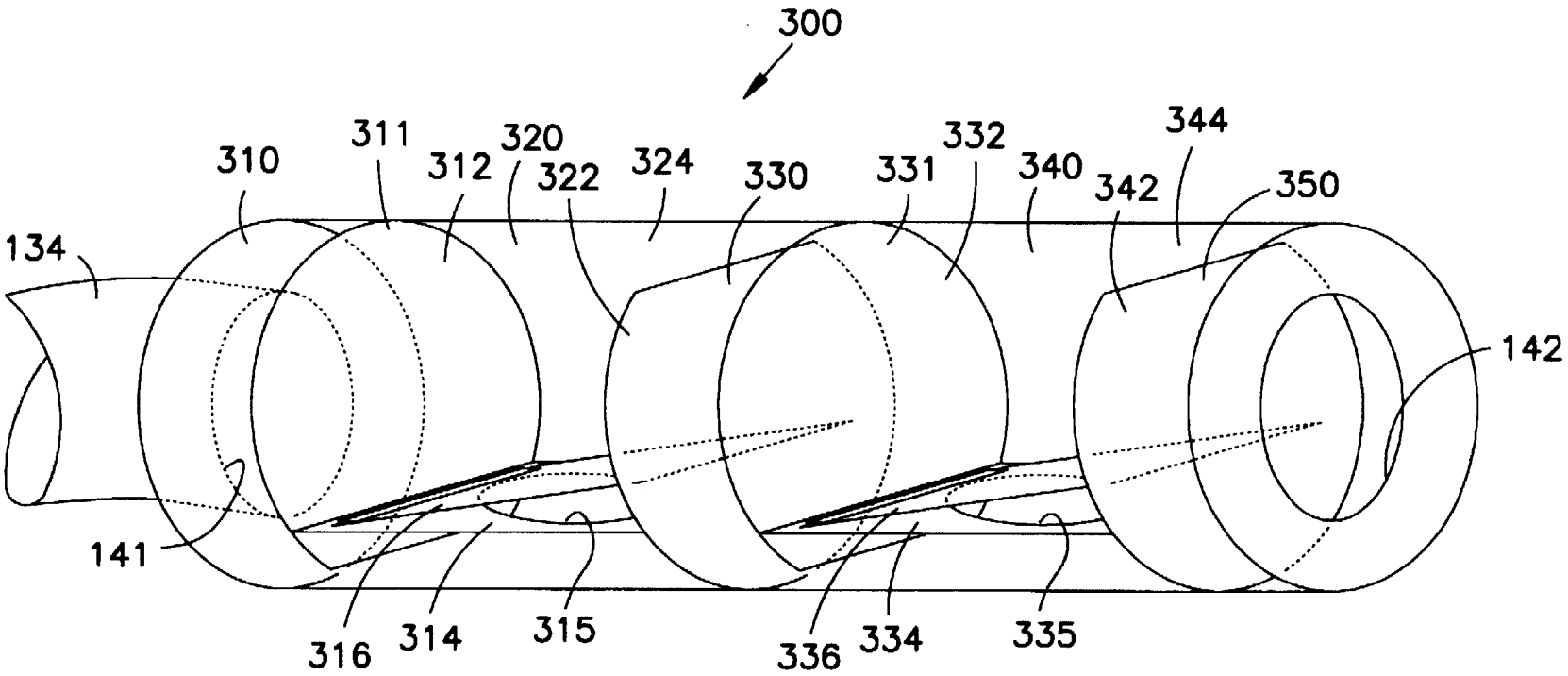
FIG. 3 is a perspective view of a second embodiment of the muffler.

FIG. 3 is a perspective view of a second embodiment of a muffler 300. The basic difference between the first embodiment of the muffler shown 140 and the second embodiment of the muffler 300 is that the exterior portion of the muffler is rounded rather than square. The muffler 300 includes a first chamber 310, a second chamber 320, a third chamber 330, a fourth chamber 340 and a fifth chamber 350. The first chamber 310 is separated from the second chamber 320 by an L-shaped wall 311 that has a first portion 312 and a second portion 314. The second portion 314 of the L-shaped wall 310 has an opening 315 therein. A flap 316 is attached to the second portion 314 of the L-shaped wall 311. The flap 316 covers the opening 315 when exhaust gas is not passing through the muffler 300. When the exhaust gas passes through the opening 315, it enters into the second chamber 320. The second chamber 320 is bounded by the L-shaped wall 311 and by the wall 322. The wall 322 has an opening 324 therein. The opening 324 is positioned along the wall at a point which is most distant from the opening 315 in the second portion 314 of the wall 311. The opening 324 allows the gas to pass from the second chamber 320 to the third chamber 330. Chamber 330 is bounded by the wall 322 and a second L-shaped wall 331. The L-shaped wall 331 includes a first portion 332 and a second portion 334. The second portion 334 has an opening 335 therein. A flap 336 is hingedly attached to the second portion 334 of the L-shaped wall 331. The flap 336 covers the opening 335 in the L-shaped wall 331 when gas is not passing through the muffler 300. Specifically, the flap 336 is closed when gas is not passing between the third chamber 330 and the fourth chamber 340. When the gas passes through the opening 335, it passes into the fourth chamber. The fourth chamber 340 is bounded by the L-shaped wall 331 and a wall 342. The wall 342 is parallel to the end wall of the muffler which has the exhaust port or exhaust opening 142 therein. The wall 342 has an opening 344 positioned along an edge which is most distant from the opening 335 that has the flap 336 thereon.

Figure 4:
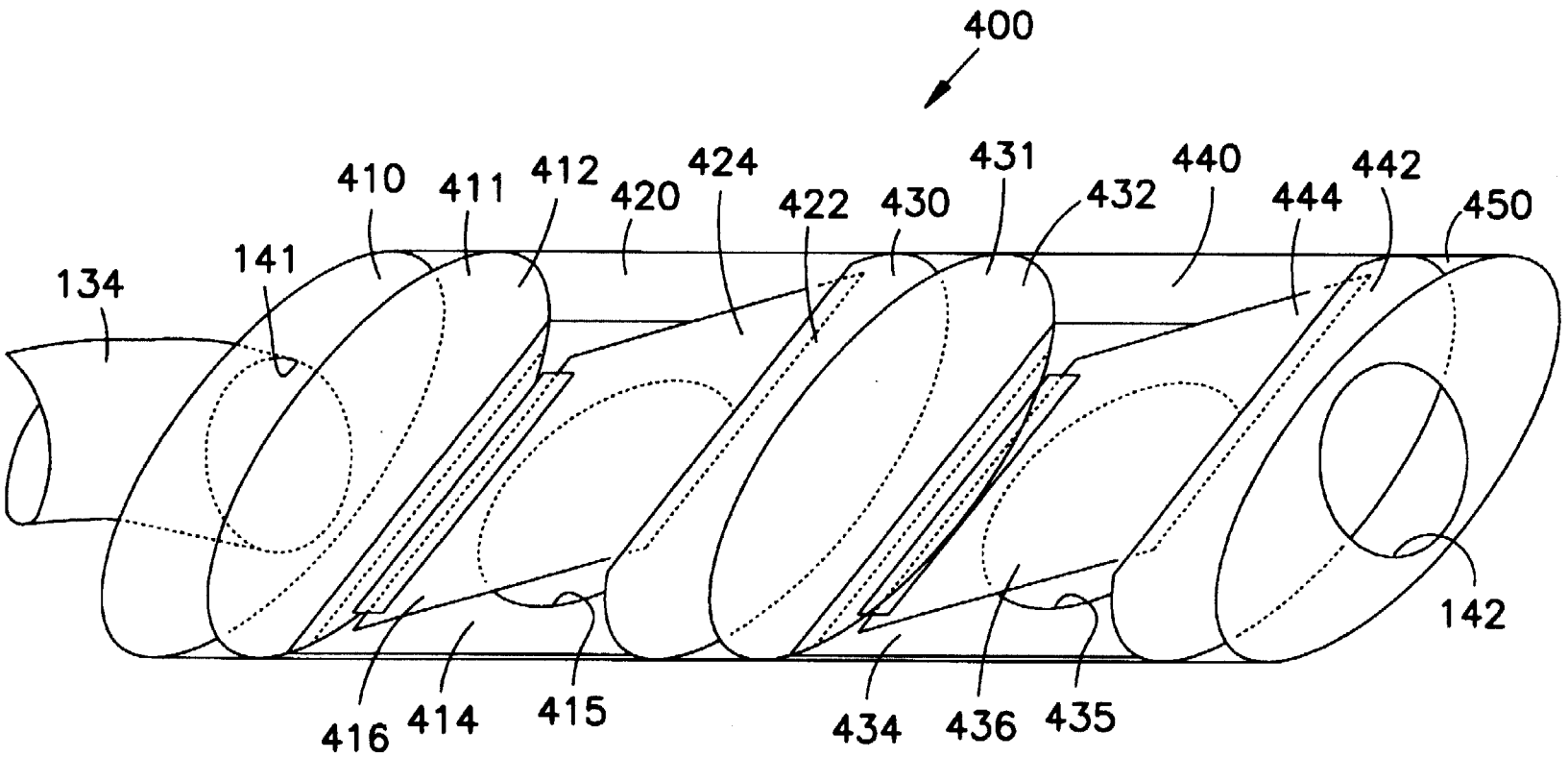
FIG. 4 is a perspective view of a third embodiment of the muffler.

Shown in FIG. 4 is a perspective view of a third embodiment of the muffler. The third embodiment of the muffler 400 differs from the first two in that the outside shape of the muffler is an oval or elliptically shaped. The basic construction inside the muffler 400 is the same in that five chambers 410, 420, 430, 440 and 450 are used. The first chamber 410 and the second chamber 420 are separated by an L-shaped wall 411. The L-shaped wall has an opening 415 therein which is covered by a flap 416. The gas from the inlet 141 passes into the first chamber 410 and is redirected such that it passes through the opening 415 and into the second chamber 420. The second chamber 420 is bound by the L-shaped wall 411 and a wall 422. The wall 422 has an opening which is most distant from the opening 415. The exhaust gas passes from the second chamber 420 to the third chamber 430 as it passes through the opening 424 in the wall 422. The third chamber 430 is bound by wall 422 and another L-shaped wall 431. The L-shaped wall 431 includes a first portion 432 and a second portion 434. The second portion of the wall includes an opening 435 which is covered by a flap 436. When the exhaust gas passes through the opening 435, it passes into the fourth chamber 440. Fourth chamber 440 is bound by the L-shaped wall 431 and a wall 442 that has an opening 444 positioned at a distance far away from the opening 435. The opening 444 is the passageway to the fifth chamber 450. As the gas passes into the fifth expansion chamber 450, it then passes out of the exhaust port or exhaust opening 142 and into the tail pipe 136.

In each of the embodiments, the portions of the L-shaped walls having an opening therein is in a plane which is transverse to the plane in which the inlet 141 and the outlet 142 openings are in. As shown in FIG. 2, the walls having flapped openings are substantially perpendicular to the walls that carry the inlet 141 and outlet 142 of the muffler. The hinged openings can also be thought of as being in planes which are parallel to the flow of the gas in the pipe 134. Although not necessary, the first and second flapped openings are essentially coplanar in the construction as shown in embodiments shown in FIGS. 2–4.

In operation, the exhaust gas passes into the first chamber, up through an opening in an L-shaped wall and past the flapper valve into a second chamber. The gas must then pass from the opening to a distant opening in the second chamber and then to a third chamber which is bounded by another L-shaped wall. The first and third chambers are substantially L-shaped. The gas passes through the third chamber in roughly an L-shaped path and through the second flapped opening into a fourth chamber. The opening to the fifth chamber is at a point which is distant from the flapped opening into the fourth chamber. In the fifth chamber, the gas passes into it on one end and out of it at the outlet 142. In essence, the gas takes a very tortuous path through the muffler 140, 300 or 400. The flaps are generally configured so that excessive back pressure will not be formed. Excessive back pressure can cause a loss of power in the internal combustion engine 110. The flaps also must be of enough weight so that they break up the surges of gas that is inherent in an exhaust gas system. The flaps tend to break up the periodic flow of the gas as it moves through the muffler 141, 300 or 400.

The arrangement shown is simpler in construction than previous mufflers which have a series of baffles or a plurality of passageways. Since the mufflers 141, 300 and 400 are less complex, these mufflers are also less expensive to build. It should be noted that they are equally effective at muffling the sounds that would normally come from an internal combustion engine. In addition, it should be noted that even though this muffler is shown for use with an automobile, that it can be also used with other vehicles including lawn mowers, riding lawn mowers, motorcycles or any other vehicle that includes an engine.

It is to be understood that the above description is intended to be illustrative, and not restrictive. Many other embodiments will be apparent to those of skill in the art upon reviewing the above description. The scope of the invention should, therefore, be determined with reference to the appended claims, along with the full scope of equivalents to which such claims are entitled.

What is claimed is:

1. A muffler apparatus comprising:

an exhaust gas inlet;

a first expansion chamber;

a second expansion chamber adjacent the first expansion chamber;

a wall between the first and second expansion chamber, said wall having an orifice therein;

a flap which covers the orifice in the wall, said flap opening in response to a surge of pressurized exhaust gas in the first expansion chamber; and an exhaust gas outlet for allowing exhaust gas to pass from the second chamber, wherein the exhaust gas inlet is in a first plane and the orifice between the first expansion chamber and the second expansion chamber is in a second plane, said first plane transverse to the second plane.

2. The muffler apparatus of claim 1, wherein the first plane is substantially perpendicular to the second plane.

3. The muffler apparatus of claim 1, further comprising a third expansion chamber positioned between the second expansion chamber and the gas outlet, said exhaust gas traveling from a position near one edge of the third expansion chamber, across the third expansion chamber to a position near another edge of the third expansion chamber.

4. The muffler apparatus of claim 3, further comprising:

a fourth expansion chamber positioned between the third expansion chamber and the gas outlet; and a second wall between the third and fourth expansion chambers, said wall having a second orifice therein.

5. The muffler apparatus of claim 4 further comprising a second flap positioned over said second orifice, said second flap opening in response to gas surges within the muffler apparatus.

6. The muffler apparatus of claim 5, wherein the second flap is attached to the second wall by a second hinge.

7. The muffler apparatus of claim 4, wherein the exhaust gas inlet is in a first plane and the second orifice between the third expansion chamber and the fourth expansion chamber is in a third plane, said first plane transverse to the third plane.

8. The muffler apparatus of claim 4, wherein the exhaust gas inlet is in a first plane and the second orifice between the third expansion chamber and the fourth expansion chamber is in a third plane, said first plane substantially perpendicular to the third plane.

9. The muffler apparatus of claim 7, wherein the first plane and the third plane are substantially parallel.

10. The muffler apparatus of claim 7, wherein the first plane and the third plane are substantially coplanar.

11. An exhaust system comprising:

an exhaust pipe attached to an engine; and a muffler attached to said exhaust pipe, said muffler further comprising:

an exhaust gas inlet;

a plurality of expansion chambers through which the exhaust gas flows;

at least one wall between adjacent expansion chambers, said wall having an orifice therein;

a flap pivotally attached to said at least one wall which covers the orifice in the wall, said flap opening in response to a pressurized surge of exhaust gas entering into the expansion chambers; and an exhaust gas outlet for allowing exhaust gas to pass from the second chamber, wherein the wall is positioned on a plane that cuts the plane in which the exhaust gas inlet is positioned.

12. The exhaust system of claim 11, wherein the plurality of chambers are attached to one another such that the exhaust gas travels along a tortuous path between the exhaust gas inlet and the exhaust gas outlet.

13. The exhaust system of claim 11, wherein the flap is positioned such that it closes due to gravitational forces.

14. The exhaust system of claim 11, wherein the exhaust system further comprises a catalytic converter attached to said exhaust pipe.

15. A muffler comprising:

an exhaust gas inlet;

a first expansion chamber within the muffler, said first expansion chamber bounded by a wall having a first orifice therein;

a first flap covering the first orifice in the wall of the first expansion chamber, said first flap opening in response to a surge of pressurized exhaust gas in the first expansion chamber;

a second expansion chamber within the muffler, said second expansion chamber bounded by a wall having a second orifice therein;

a second flap covering the second orifice in the wall of the second expansion chamber, said second flap opening in response to a surge of pressurized exhaust gas in the second expansion chamber; and an exhaust gas outlet for allowing exhaust gas to pass from the muffler.

16. The muffler of claim 15 wherein exhaust gas passes the first flap and the second flap, wherein the first flap and the second flap are positioned so that the exhaust gas travels along a tortuous path.

17. The muffler of claim 15 wherein the wall having the first orifice defines a first plane and the wall having the second orifice defines a second plane, said first plane substantially parallel to the second plane.

18. The muffler of claim 15 wherein the wall having the first orifice defines a first plane and the wall having the second orifice defines a second plane, said first plane substantially coplanar with the second plane.

* * * * *